United States Patent [19]

Nolt

[11] 4,380,207

[45] Apr. 19, 1983

[54] ANCHORING APPARATUS

[75] Inventor: Edwin B. Nolt, New Holland, Pa.

[73] Assignee: Sperry Corporation, New Holland, Pa.

[21] Appl. No.: 298,697

[22] Filed: Sep. 2, 1981

[51] Int. Cl.[3] ..... B63B 21/24

[52] U.S. Cl. ..... 114/298; 114/297; 114/304

[58] Field of Search ..... 114/294–310

[56] References Cited

U.S. PATENT DOCUMENTS

| | | | |
|---|---|---|---|
| 730,009 | 6/1903 | Duncanson | 114/307 |
| 1,804,273 | 5/1931 | Pelkey | 114/297 |
| 3,491,712 | 1/1970 | Ross | 114/298 |

*Primary Examiner*—Trygve M. Blix
*Assistant Examiner*—D. W. Keen
*Attorney, Agent, or Firm*—Larry W. Miller; Frank A. Seemar; Darrell F. Marquette

[57] ABSTRACT

An anchoring apparatus includes a resiliently urged cam assembly. Flukes of the apparatus are automatically set in a sea bed engaging position and are releasable for permitting removal from the sea bed. The flukes are then automatically reset.

10 Claims, 5 Drawing Figures

10
12
38
22
16
26
18
20
62
36
94
92
32
90
14
40
34
44b
44a
102
24
25
100
104
28
3
4
5
2

ANCHORING APPARATUS

BACKGROUND OF THE INVENTION

This invention relates generally to ship anchors and, more particularly, to an anchoring apparatus having means directing collapsible flukes in a sea bed engaging position and providing for movement of the flukes to a release position. The flukes are then automatically reset.

It is well known that anchoring apparatus have been provided to aid in maintaining a ship in a substantially stationary position in the water. This was accomplished by the fact that an anchor had sufficient weight to drag and/or engage the sea bed.

Later, anchors were developed to do away with a substantial amount of weight in favor of flukes which would penetrate the sea bed. Along this line of development, it became desirable to have flukes which were collapsible or otherwise movable for release from the sea bed. However, most of these anchors required elaborate means for setting the flukes in the sea bed and upon release, the flukes had to be reset in some manner for reuse.

The foregoing illustrates limitations of the known prior art. Thus, it is apparent that it would be disadvantageous to provide an alternative directed to overcoming one or more of the limitations as set forth above. Accordingly, a suitable alternative is to provide an anchoring apparatus which is automatic and simplified for release from and engagement with the sea bed.

SUMMARY OF THE INVENTION

In one aspect of the present invention, this is accomplished by providing an anchoring apparatus for automatically setting and resetting a releasable fluke in a sea bed engaging position including a housing having a resiliently mounted roller urged into engagement with a cam assembly. The fluke is mounted for movement relative to the cam assembly. The fluke includes a leg extension attached to one end thereof.

The foregoing and other aspects will become apparent from the following detailed description of the invention when considered in conjunction with the accompanying drawings. It is to be expressly understood, however, that the drawings are not intended as a definition of the invention but are for the purpose of illustration only.

DESCRIPTION OF THE PREFERRED EMBODIMENT

Figure 1:
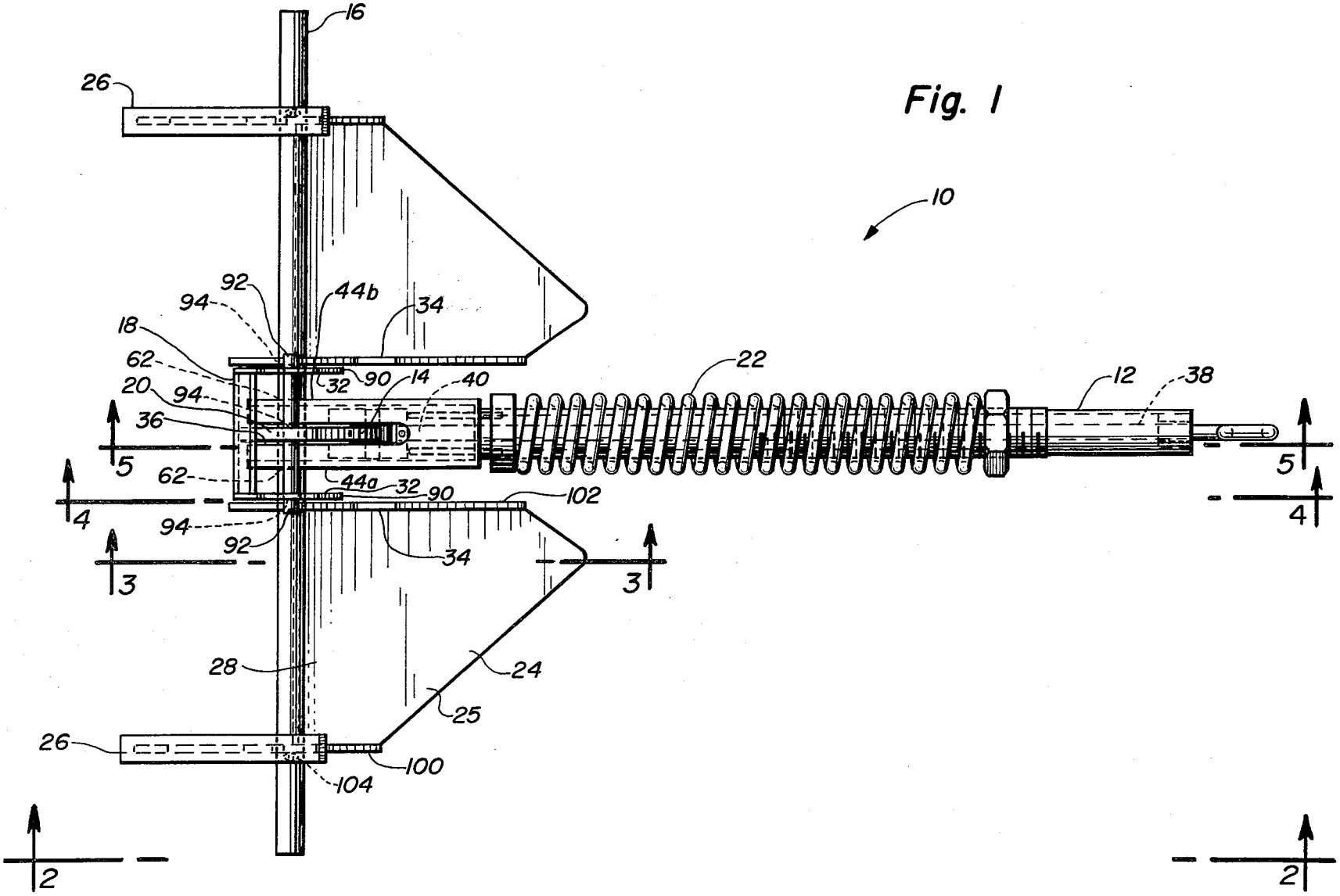
FIG. 1 is a plan view illustrating an embodiment of the anchoring apparatus of this invention.

The anchoring apparatus 10 of this invention generally includes a housing 12; a cam roller 14 resiliently mounted with the housing 12 and movable relative thereto; a support 16 extending through the housing 12; a cam assembly 18 movably mounted on the support 16 and having a first portion 20 extending through the housing 12; means 22 connected for resiliently urging the roller 14 into engagement with the first portion 20 of the cam assembly 18; a fluke 24 movably mounted on the support 16 and movable relative to the cam assembly 18; a leg extension 26 attached to one end 28 of the fluke 24; and means for limiting movement of the fluke 24 relative to the cam assembly 18. The means 22 for resiliently urging the roller 14 into engagement with the cam assembly 18 is adjustable, as will be discussed later in greater detail. The cam assembly 18 includes a second portion 32 pivotal relative to and outside of a housing 12. The means for limiting movement of the fluke 24 includes means such as ears 34 formed on the fluke for engagement with the second portion 32 of the cam assembly 18. The housing 12 includes a cam receiving slot 36 formed therein. A plunger 38 is resiliently mounted in the housing 12 and carries the roller 14 at one end 40 thereof. The roller 14 and the first portion 20 of the cam assembly 18 extend into the cam receiving slot 36.

Figure 5:
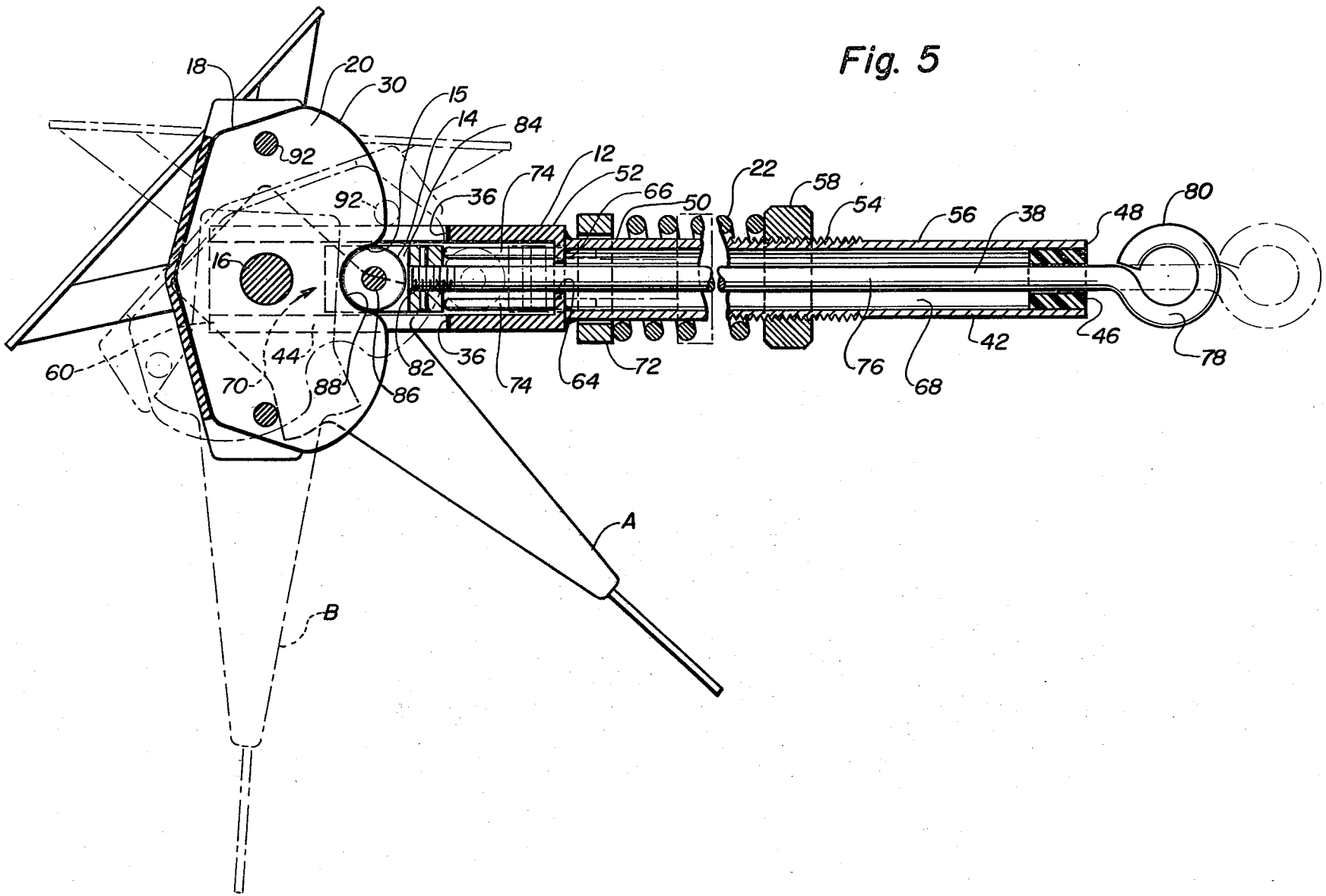
FIG. 5 is a cross-sectional side view taken along line 5—5 of FIG. 1.

The housing 12, FIG. 5, is preferably formed of steel and includes a hollow tubular portion 42 and a hollow rectangular portion 44. The tubular portion 42 has a nylon washer 46 inserted in a first end 48 thereof. A second end 50 of the tubular portion 42 is preferably welded to a first end 52 of the rectangular portion 44. Threads 54 are perferably formed on an outer surface 56 of the tubular portion 42 and a nut 58 is threadably engaged with the threads 54. A second end 60 of the rectangular portion 44 is open ended and has the cam receiving slots 36 extending therefrom toward the first end 52 of the rectangular portion 44. Also, aligned bores 62 are formed for receiving support 16 in two opposed walls **44*a*,44*b* (FIG. 1) of the rectangular portion 44 adjacent the second end 60 thereof. An opening 64 in a wall 66 of the rectangular portion 44 of the housing 12 adjacent the welded interconnection between the tubular 42 and rectangular portions 44 interconnects the inner hollow areas 68,70 of the tubular 42 and rectangular 44** portions, respectively.

A coil spring seat, FIG. 5, comprises a steel ring 72 and preferably four steel legs 74. The spring seat is mounted on the housing 12 adjacent the welded interconnection between the tubular 42 and rectangular 44 portions. The ring 72 of the seat is slidably mounted on the tubular portion 42 and the legs 74 extend through the wall 66 at the first end 52 of the rectangular portion 44 and into the inner hollow area 70 thereof.

A steel coil compression spring 22 is mounted on the tubular portion 42 of the housing 12 and is retained between ring 72 of the spring seat and nut 58 threaded onto the threads 54 of the tubular portion 42. In this manner, compression of the coil spring 22 can be adjusted. Spring 22 thus functions as a means for resiliently urging roller 14 into engagement with first portion 20 of cam assembly 18.

Plunger 38, FIG. 5, comprising an elongated rod 76 extends through the tubular portion 42 and into the rectangular portion 44. The rod 76 is guided by the nylon washer 46 mounted in the cylindrical portion 42 of the housing 12. A loop 78 formed on a first end 80 of the rod 76 is provided for receiving an anchor rope or chain. A second end 82 of the rod includes the cam roller 14. A roller retainer 84 is threaded on the second end 82 of the rod 76 and the roller 14 is rotatably mounted on the retainer 84 via a press fit pin 86. The plunger 38 with its cam roller 14 may be moved within the housing 12. The legs 74 of the spring seat engage the roller retainer 84 so that the roller 14 is resiliently mounted in the housing 12 by the coil spring 22.

Figure 4:
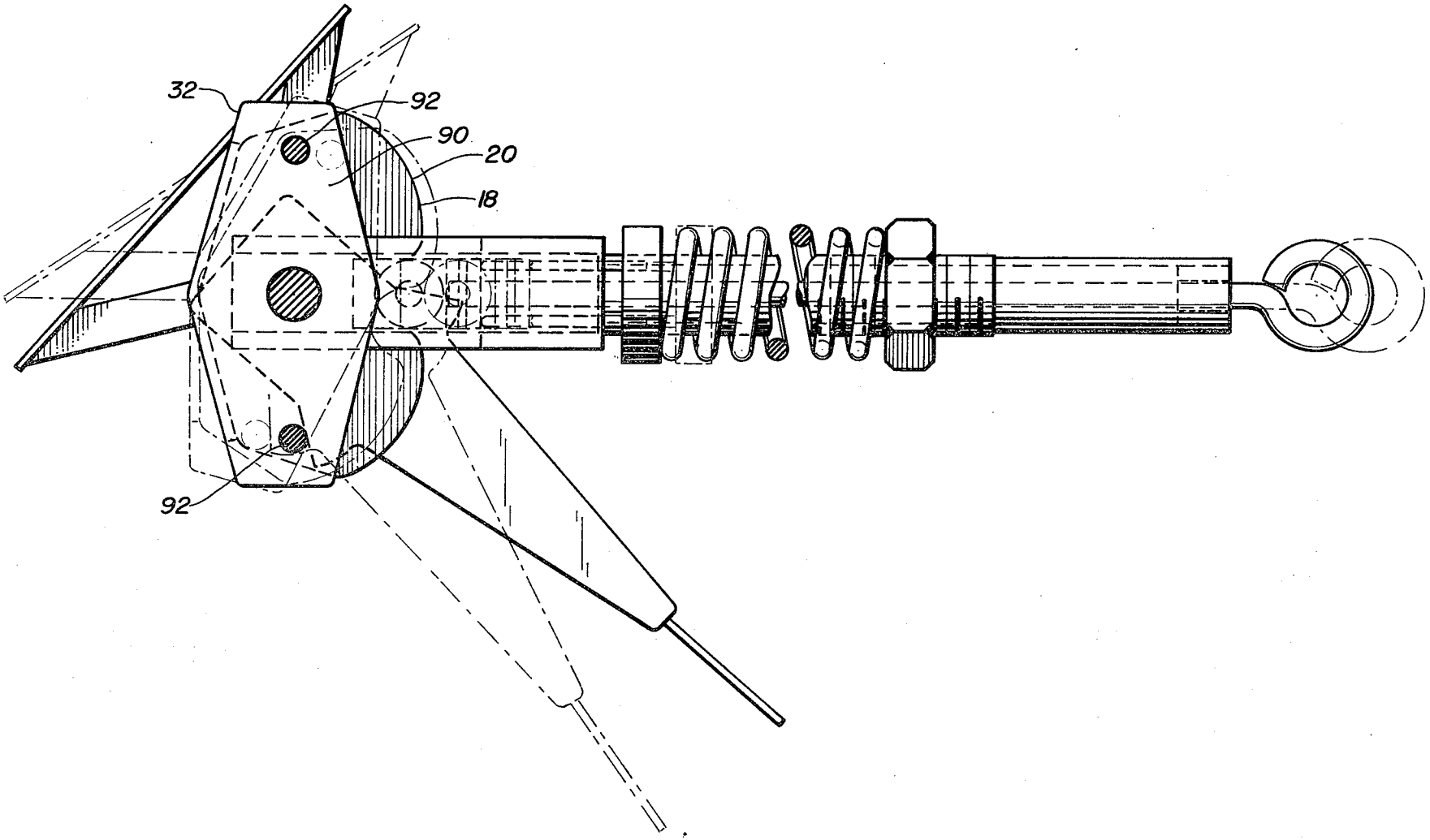
FIG. 4 is a fragmentary cross-sectional side view taken along line 4—4 of FIG. 1.

The elongated support rod 16, FIGS. 1 and 5, preferably of steel extends through the aligned bores 62 formed in the opposed walls 44*a*,44*b* of the housing 12. Cam assembly 18 is movably mounted to pivot on the support 16 relative to the housing 12. The cam assembly 18 includes first substantially planar portion 20 including an arcuate edge 30 extending through the cam receiving slots 36 of the housing 12 and into engagement with the cam roller 14. In this manner, an arcuate edge 15 of the cam roller 14 is resiliently urged into engagement with the cam assembly 18. The substantially planar first portion 20 of the cam assembly 18 includes a notch 88 formed in the arcuate edge 30 which receives the cam roller 14. The second portion 32 of the cam assembly 18 includes a pair of plates 90 (FIGS. 1 and 4) substantially parallel with the first portion 20 and supported adjacent opposed sides of the first portion 20 and outside of the housing 12 by a pair of bars 92 extending through and beyond the plates 90. Aligned bores 94 are formed in each of the plates 90 and in the planar first portion 20 for receiving the support rod 16 which extends therethrough and also extends through the aligned bores 62 in the rectangular portion 44 of the housing 12. In this manner, the cam assembly 18 is pivotally mounted on the support member or rod 16.

Figure 2:
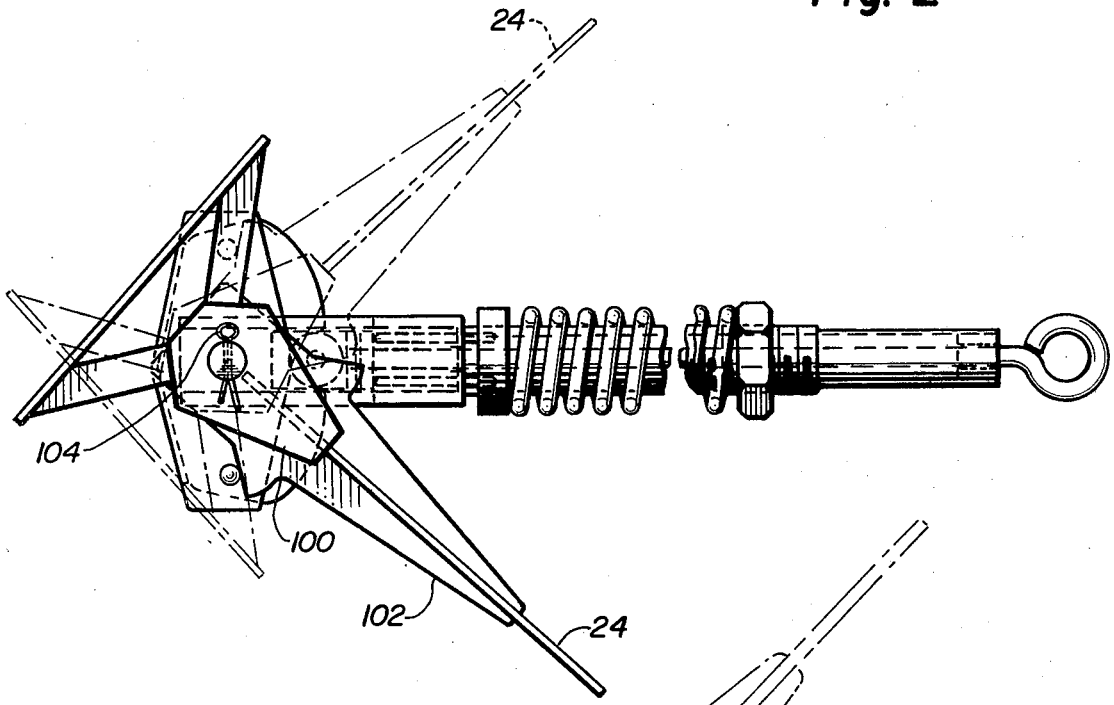
FIG. 2 is a fragmentary cross-sectional side view taken along line 2—2 of FIG. 1.
Figure 3:
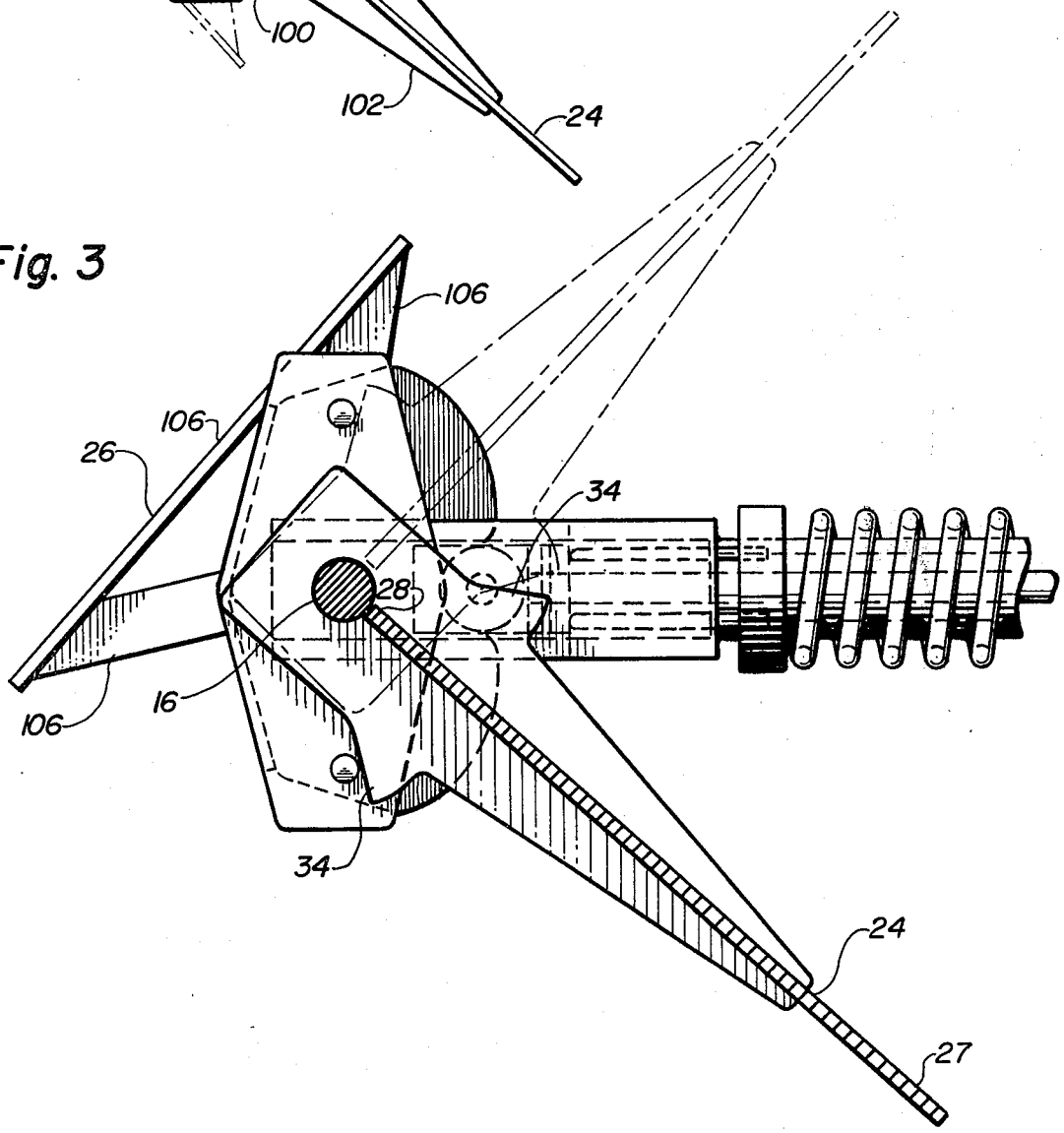
FIG. 3 is a fragmentary cross-sectional side view taken along line 3—3 of FIG. 1.

At least one fluke 24 (FIGS. 1, 2 and 3) and preferably a pair of flukes 24 are pivotally mounted on the support rod 16 on opposite sides of the cam assembly 18. The flukes 24 are movable relative to the support rod 16 and relative to the cam assembly 18. The flukes 24 are generally planar members 25 having first 27 and second 28 ends and a pair of side plates 100,102 and are retained on the support rod 16 by cotter pins 104. The ears 34 formed on each of the side plates 102 adjacent the cam assembly 18 engage the extended portion of the bars 92 on the cam assembly 18 in response to the fluke 24 being pivoted on the support member 16. Thus, the ears 34 limit the movement of the flukes 24 due to engagement with the bars 92 extending from the cam assembly 18. The leg extension 26 is formed on the second end 28 of each fluke 24. The leg extension 26 is of a construction sufficient to engage the sea bed and to direct the pointed first end 27 of the fluke 24 into or toward the sea bed. Leg extension 26 is preferably formed of three steel leg portions 106 welded together and welded to plate 100 at second end 28 of fluke 24.

With the parts assembled as set forth above, it can be seen that with the coil spring 22 adjusted to a preferred position, the cam roller 14 is urged into engagement with the arcuate surface 30 of the first portion 20 of the cam assembly 18 such that the cam assembly 18 is rotated until the roller 14 seats into the notch 88 formed in the first portion 20 of the cam assembly 18. As a result, one of the ears 34 on each fluke 24 engages an extended bar portion 92 of the cam assembly 18 which orients the fluke 24 in a downward direction in a sea bed engaging position designated A (FIG. 5). Due to gravity and the permitted relative movement between the flukes 24 and the cam assembly 18, the pointed first ends 27 of the flukes 24 will be oriented downward even if the anchor housing 12 is flipped over or rotated 180 degrees. To assist in this orientation the extended leg portion 26 of the fluke 24 will also insure that the pointed first end 27 of the fluke 24 is directed in a sea bed engaging position.

With an anchor, rope or chain attached to the loop 78 at the end 80 of the rod 76, a force exerted on that rope will compress the spring 22 when the cam roller 14 is moved away from the cam assembly 18. This may occur when, for example, a boat is powered to move from one fishing location to another. As a result, the cam assembly 18 will be released from engagement with the roller 14 and the entire cam assembly 18 will rotate until one of the bars 92 engages the rectangular portion 44 of the housing (FIG. 5 ). This permits the flukes 24 to be released by rotating to a release position designated B (FIG. 5) out of engagement with the sea bed. Once the force is released from the rope attached to the rod 76, such as when, for example, the boat comes to rest in the water at a desired fishing location, the stored energy in the coil spring 22 will force the roller 14 into engagement with the arcuate surface 30 of the first portion 20 of the cam assembly 18 and rotate the cam assembly 18 until the roller 14 seats in the notch 88. At a certain point in this rotation, ears 34 of the flukes 24 will engage bars 92 of the cam assembly 18 and the flukes 24 will be rotated until they are reset in the sea bed engaging position designated A (FIG. 5).

It will be understood by one skilled in the art that the spring 22 must be of appropriate size and strength to exert sufficient biasing force on the cam roller 14 to maintain it in engagement with the first portion 20 of the cam assembly 18 as the boat is drifting on the waves and, thereby, exerting a minimal amount of force on the rope attached to the loop 78 of the rod 76, i.e., an amount of force less than the biasing force of the spring 22. However, the spring 22 would not exert a biasing force sufficient to withstand the force exerted on the rope attached to the plunger 38 by a boat driven by a motor. In this manner, the anchoring apparatus 10 can be released or disengaged from the sea bed without specially maneuvering the boat to change the relative positions of the housing 12 and the flukes 24. Once the anchoring apparatus 10 is released from the sea bed and the resisting force encountered by the flukes 24 is less than the biasing force exerted by the spring 22, the flukes 24 will be reset in their sea bed engaging position through the cooperative action between the roller 14 and the pivoted cam assembly 18.

The foregoing has described an anchoring apparatus which is automatic and simplified for engagement with and release from the sea bed.

It is anticipated that aspects of the present invention, other than those specifically defined in the appended claims, can be obtained from the foregoing description and the drawings.

Having thus described the invention, what is claimed is:

1. In an anchoring apparatus having a housing; a support extending through said housing; a fluke movably mounted on said support for movement relative to said housing between a sea bed engaging position and a release position, the improvement comprising:

a cam assembly movably mounted on said support for movement between a first position and a second position, said cam assembly having a first portion extending through said housing and being movable relative to said fluke;

a cam roller resiliently mounted with said housing for movement toward and away from said cam assembly, said cam roller being engageable with said first portion of said cam assembly;

spring means connected to said roller to bias said roller into engagement with said first portion and for releasably holding said cam assembly in said first position;

actuating means connected to said cam roller and being selectively operable to effect movement of said cam roller away from said cam assembly to permit said cam assembly to move to said second position, the release of the operation of said actuating means to permit said spring means to urge said cam roller against the first portion of said cam assembly effecting the return of said cam assembly to said first position; and limit means for limiting movement of said fluke relative to said cam assembly, said limit means being operable to permit said fluke to move to said release position when said cam assembly moves to said second position and to effect a movement of said fluke to said sea engaging position when said cam assembly moves from said second position to said first position.

2. The apparatus of claim 1 wherein said actuating means includes a plunger having said cam roller connected thereto at one end and being adapted for connection to a boat via a flexible link at an opposing end, a pulling on said flexible link causing said cam roller to move away from said cam assembly and compress said spring means.

3. The apparatus of claim 2 wherein said spring means includes a spring seat engaged with said cam roller and a coil compression spring interconnecting said housing and said spring seat to urge said cam roller into engagement with said first portion of said cam assembly.

4. The apparatus of claim 3 wherein said first portion of said cam assembly includes an arcuate surface disposed such that the force exerted by said spring through said cam roller on said arcuate surface effects a movement of said cam assembly into said first position.

5. The apparatus of claim 4 wherein a notch is formed in the arcuate surface of said first portion of said cam assembly, said cam roller being positioned in said notch when said cam assembly is in said first position.

6. The apparatus of claim 5 wherein said cam assembly is pivotally mounted on said support, said cam assembly further including a second portion positioned outside of said housing, said limit means including ears formed on said fluke for engagement with said second portion of said cam assembly to limit movement of said fluke relative thereto.

7. The apparatus of claim 6 wherein said fluke includes a leg extension attached at one end thereof to engage the sea bed and direct said fluke toward engagement with said sea bed.

8. The apparatus of claim 6 wherein said housing includes a threaded portion and a nut threaded thereon, said spring being disposed between said nut and said spring sea, the biasing force exerted by said spring being adjustable by manipulation of the position of said nut on said housing.

9. The apparatus of claim 8 wherein said spring seat includes a ring member slidably mounted on the outside of said housing and at least two leg members connected to said ring member and extending through openings in said housing into the interior of said housing for engagement with said cam roller.

10. The apparatus of claim 9 wherein said cam roller includes a roller retainer threaded onto said plunger and a roller member rotatably mounted on said roller retainer by a pin.

* * * * *